United States Patent [19]

Leumi

[11] Patent Number: 4,860,909

[45] Date of Patent: Aug. 29, 1989

[54] TRASH RECEPTACLE MOUNTED FOR ROTATION

[76] Inventor: Dov A. Leumi, 812 S. 9th St., Philadelphia, Pa. 19147

[21] Appl. No.: 149,346

[22] Filed: Jan. 28, 1988

[51] Int. Cl.[4] ..... B65F 1/12

[52] U.S. Cl. ..... 220/1 T; 211/81; 211/84; 248/130; 248/142; 248/291; 248/907

[58] Field of Search ..... 220/1 T, 18; 211/81–84, 71, 110; 248/122, 130, 131, 134, 229, 230, 291, 292.1, DIG. 7, 133, 140–142

[56] References Cited

U.S. PATENT DOCUMENTS

| | | | |
|---|---|---|---|
| 528,259 | 10/1894 | McKenzie | 248/142 |
| 947,640 | 1/1910 | LeNeson | 248/142 |
| 1,791,019 | 2/1931 | Wilson | 248/DIG. 7 |
| 2,086,355 | 7/1937 | Eansor | 248/130 |
| 2,138,858 | 12/1938 | Hjelm | 248/131 |
| 2,303,067 | 11/1942 | Richard | 248/134 |
| 2,952,434 | 9/1960 | Blanchard | 211/81 X |
| 3,091,342 | 5/1963 | Crump | 248/DIG. 7 |
| 3,212,743 | 10/1965 | Culver | 248/229 |
| 3,273,569 | 9/1966 | Caliovette | 248/130 |
| 3,279,732 | 10/1966 | Paul | 248/DIG. 7 |
| 3,840,204 | 10/1974 | Thomas et al. | 211/81 X |
| 4,306,699 | 12/1981 | Neufeldt | 248/134 |

*Primary Examiner*—Bryon P. Gehman

*Attorney, Agent, or Firm*—Caesar, Rivise, Bernstein, Cohen & Pokotilow, Ltd.

[57] ABSTRACT

A trash receptacle having a pair of baskets rotatably mounted on a support. Each basket is fixable in an upright position by a latching member which prevents rotation of the basket about a horizontal axis unless the basket is being emptied.

3 Claims, 2 Drawing Sheets

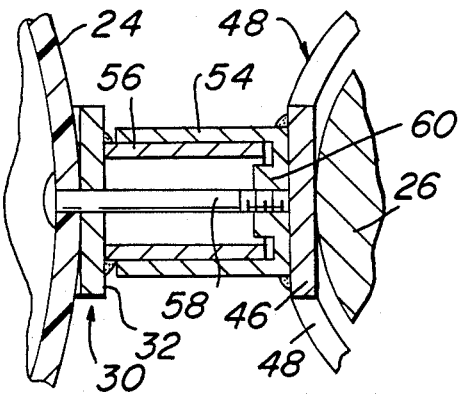
FIG. 3
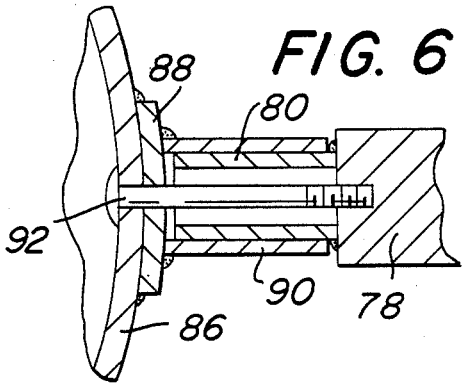
FIG. 6
FIG. 4
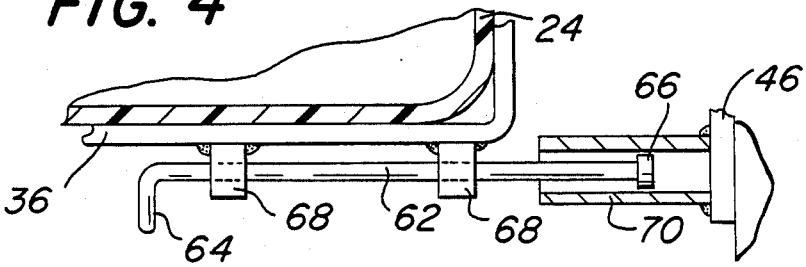
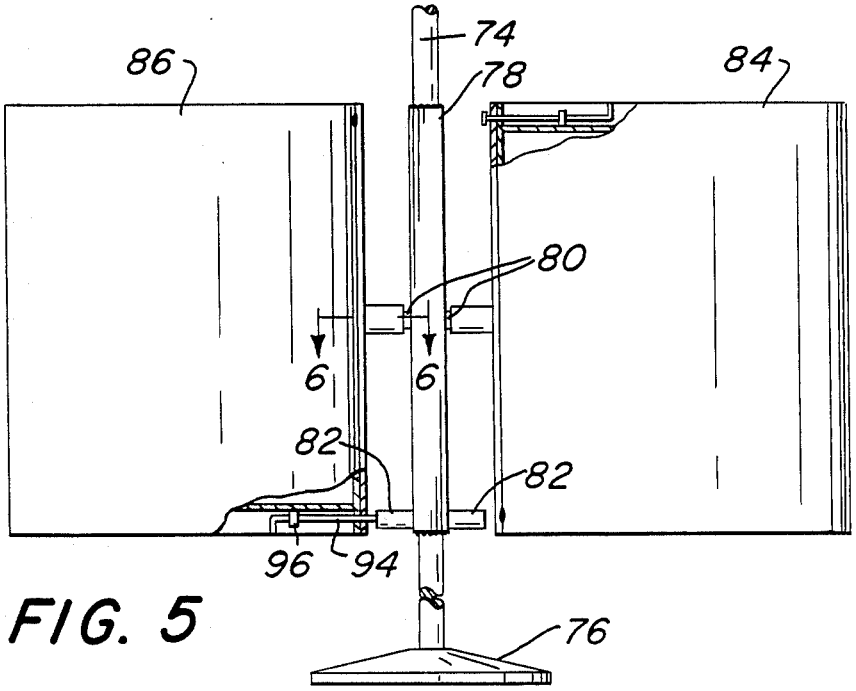
FIG. 5

TRASH RECEPTACLE MOUNTED FOR ROTATION

FIELD OF THE INVENTION

This invention relates generally to waste disposal and recycling and more particularly to a trash receptacle which is rotatably mounted upon a vertical support.

BACKGROUND ART

Providing suitable trash receptacles in public places for waste disposal and recycling has been a problem for many reasons. Among these reasons are the fact that receptacles that are left open for use by the public often fill up with water when it rains and are difficult to empty because of the weight of water at the bottom of the receptacles. Where open receptacles are used, water can still collect at the bottom of the receptacle. In addition, the trash receptacles are often removed where they are portable by reason of theft or automobiles brushing them aside and causing them to roll away. Finally, a single receptacle is often not sufficient where recycling of the trash is desired. Often different types of materials must be collected in different receptacles.

OBJECT OF THE INVENTION

It is therefore an object of the invention to overcome the disadvantages of the prior art.

Another object of the invention is to provide a new and improved trash receptacle to facilitate collecting or removal of trash which is disposed on a vertical support and is rotatably mounted thereon.

Yet another object of the invention is to provide a new and improved trash receptacle which includes a basket in which water which is collected may be easily removed.

Still another object of the invention is to provide a new and improved trash receptacle system which facilitates providing a plurality of baskets on a single vertical support.

These and other objects of the invention are achieved by providing a trash receptacle to facilitate collecting and removal of trash. The trash receptacle includes a basket portion and a supporting member for the basket. The supporting member is connected to the basket by a rotatable mounting means which enables the basket to be rotated with respect to the support and means for fixing the basket with respect to the support when the basket is being used as a receptacle for receiving trash. The support member preferably comprises a pair of diametrically opposed journal members which facilitate mounting a pair of the receptacles on opposite sides of a vertical support.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 3 is an enlarged sectional view taken along the line 3—3 in FIG. 1;

FIG. 4 is an enlarged partially fragmentary view taken within the portion labeled FIG. 4 in FIG. 1;

FIG. 5 is an alternate embodiment of the support for the trash baskets embodying the invention; with portions shown in section for the purpose of clarity and FIG. 6 is an enlarged sectional view taken along the line 6—6 in FIG. 5.

DESCRIPTION OF THE PREFERRED EMBODIMENT OF THE INVENTION

Figure 1:
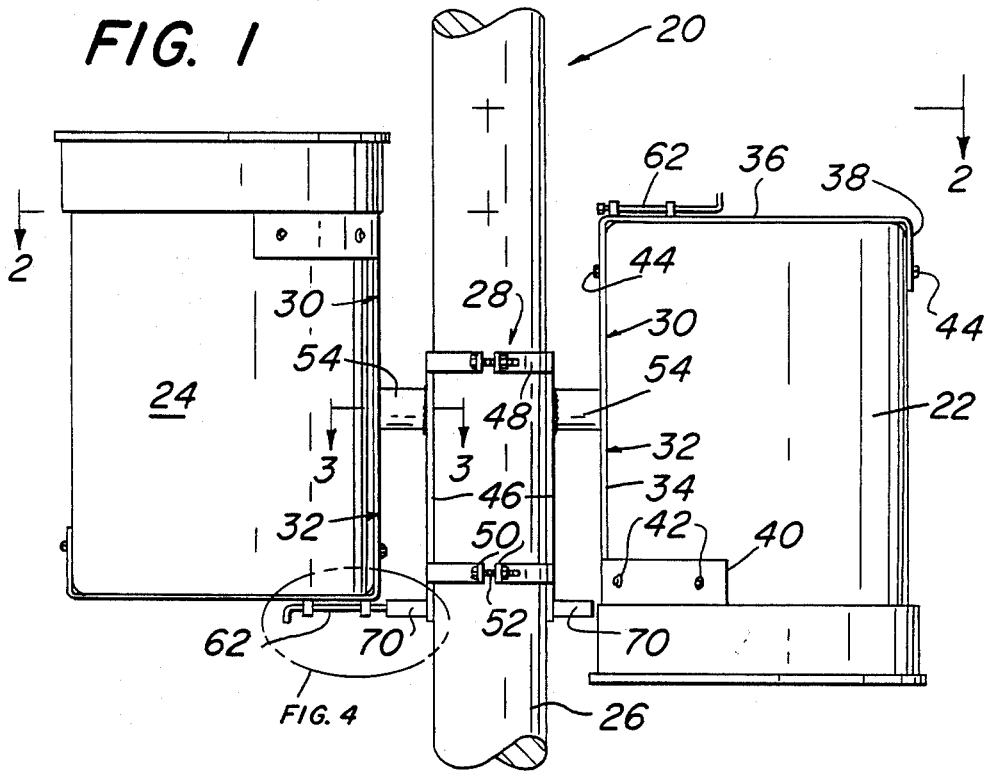
FIG. 1 is a side elevational view of a pair of trash receptacle embodying the invention.

Referring now in greater detail to the various figures of the drawings wherein like reference numerals refer to like parts, a trash receptacle embodying the invention is shown generally at 20 in FIG. 1.

The trash receptacle 20 includes a pair of baskets 22 and 24 each of which may be used as a receptacle for trash.

Each of the baskets 22 and 24 are preferably supported by a vertical pole 26 such as a light pole used by a municipality for lighting the streets.

The baskets 22 and 24 are connected to the light pole by a mounting bracket 28. As will hereinafter be seen bracket 28 is used to rotatably mount the baskets 22 and 24 on the vertical pole 26.

Each basket 22 includes a frame 30 which is used for supporting the trash baskets 22 and 24 on bracket 28. The frames 30 each are used to fixedly support the baskets in an upright position or enable the baskets to be rotated about a horizontal axis transverse to pole 20.

The mounting frames 30 each include an "L" shaped strap 32 which includes an elongated straight portion 34 which is disposed in a vertical plane and an integral transversely disposed portion 36 which is in contact with the bottom portion of the baskets and extends horizontally and a flange 3 which is also disposed in a vertical plane parallel to portion 34.

In addition to the elongated straight portion 34, there is provided an arcuate strap 40 which is integral with the portion 34 of frame 30 and is suitably secured to the outer surface of the trash baskets by suitable fasteners 42. The "L" shaped strap 32 is also connected by suitable fasteners 44 to the sides of the basket adjacent the bottom portion.

Bracket 28 is comprised of two parts each having a vertically disposed straight planar portion 46 and a pair of arcuate straps 48 which are disposed on the top and adjacent the bottom of portion 46.

Figure 2:
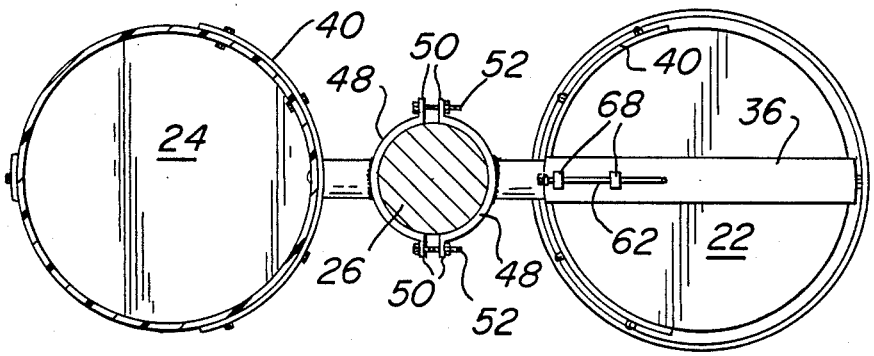
FIG. 2 is a combination sectional and plan view taken along the line 2—2 in FIG. 1.

Each of the arcuate straps have integral planar flanges 50 at each end as best seen in FIG. 2 which extend outwardly from said arcuate portions of straps 48 and are preferably coplanar. Each flange 50 includes an opening to receive a fastener 50. The flanges 50 are used with suitable threaded fasteners 52 to connect the straps together. When the straps 48 are disposed on the post 26 and connected together by fasteners 52 about pole, the straps 48 embrace the outer surface of the post to secure the vertical strap portions 46 against the opposite sides of the post diametrically opposed from each other.

Each of the vertical straps 46 of the bracket 28 include cylindrical collars 54 which are integrally mounted on the vertical straps 46 preferably by welding. As best seen in FIG. 3, the "L" shaped strap 32 of bracket 30 also includes a cylindrical collar 56 which is welded to strap 32. Collars 54 and 56 extend transversely to strap 32 and straight portion 48.

The collar acts as a journal for collar 56 to enable the brackets 30 and 48 to be rotatably mounted with respect to each other. This pivotable member also supports the trash baskets 22 and 24 rotatably with respect to the vertical support 26.

As best seen in FIG. 3, a suitable fastener 58 extends through the side wall of the trash basket 24 and through an opening provided therefor in the collar 56 and extend axially through the cylindrical collar 54 to be threadedly secured in an integral boss 60 of collar 54 to rotatably connect the bracket 30 to the bracket 38.

As best seen in FIG. 1 and FIG. 4, disposed at the bottom of each bracket 30 is a slideable support for a slideable elongated rod 62. The slideable rod 62 includes an "L" shaped end member 64 and an enlarged head 66. The rod 62 is slideably disposed within a pair of rectangular members 66 which are suitably welded to the bottom of strap 36 and include horizontally disposed aligned openings through which rod 62 is slideably disposed.

The enlarged head 66 may be aligned with a cylindrical member 70 so that the enlarged head 66 may be slid axially within the bore of collar 70. The collar 70 is suitably secured by welding to the vertical plate portion 46 of the bracket 28. Collar 70 is disposed adjacent to the bottom of the vertical plate 46 with the axis thereof disposed horizontally. When the rod 62 is slid into the collar 70, it prevents rotation of the baskets 22 and 24 with respect to the vertical pole 26.

As seen in FIG. 1, the trash basket 22 is rotated to an up-side-down position with the rod 62 thereof disposed in a position pulled back with respect to the collar 70. However, basket 24 in FIG. 1 is shown in a upright position with the rod 62 shown disposed in an aligned position with collar 70 and the rod inserted into the collar 70 to fix the basket 24 against rotation with respect to the vertical light pole 26.

It can therefore be seen that in a normal position the trash baskets 22 and 24 have the open face up and are mounted as is trash basket 24 in FIG. 1. The rod 62 is normally disposed within the collar 70 and is fixed against rotation about a horizontal axis through collar 54.

When it is desired to empty the basket, the rod 62 may be pulled out of the collar 70 and the trash baskets are rotated about the axis through collars 54 for emptying the basket. It can be seen that the rotation of the basket about the axis through collar 54 requires much less effort than does lifting the basket 22 with all of its contents and then rotating the basket so that the contents can be emptied out by gravity by movably supporting the basket.

The embodiment shown in FIG. 1 permits the easy installation of a pair of baskets on a vertical standard such as a light post. The basket walls may either be impervious as shown or have openings throughout the walls such as in mesh baskets.

An alternate embodiment of the invention comprises providing a stand-alone post having two baskets mounted on diametrically opposed sides of the post.

As best seen in FIGS. 5 and 6, the post basically comprises a vertical post 74 which has at its lowermost end a weighted base 76 for supporting the post 74 in a vertical position. The post 74 is comprised of two cylindrical rod portions which are welded at opposite ends of a square cross-sectioned central portion. The axis of each of the portions of post 74, are linearly aligned.

The square portion 78 of the post includes a pair of diametrically opposed cylindrical collars 80 and pair of diametrically opposed cylindrical collars 82 at the bottom thereof. The collars 80 and 82 extend transversely to portion 78 of the post and are preferably welded thereto.

As best seen in FIG. 6 the collars 80 are used for rotatably mounting baskets 84 and 86 on opposing sides of the post 74. As best seen in FIG. 6 basket 86 includes a vertically disposed elongated plate 88 which is welded to the basket and has secured thereto a collar 90 which is preferably secured to the plate 88 by welding. Plate 88 extends along the length of each of the baskets 84 and 86 and preferably has an arcuate cross-section to fit snugly against baskets 84 and 86.

The collar 90 fits rotatably over collar 80 so that each basket can be rotated with respect to the vertical post 74. A suitable fastener 90 extends through both the side of basket 86 and plate 88 through an opening provided therefor and through the center along the axis of collar 90 and may be threadly secured to the portion 78 of post 74. The axes of collars 80 and 90 are coextensive and horizontally disposed and extend transverse to the plate 88.

It can be seen that each of the baskets 84 and 86 also include a slideable rod member 94 which has a construction similar to the construction of rod 62 and which is slideably mounted in a rectangular member 96 which is secured to the bottom of each of the baskets 84 and 86. An enlarged head is provided on the rod 94 for fitting of the rod into collars 82 for fixing the baskets 84 and 86 against rotation when the rods are inserted into the collars 82. An opening in rectangular member 96 is provided which is aligned with an opening in the side wall of basket 86 and plate 88.

It can therefore be seen that the operation of the waste baskets embodying the invention in both the bracket form for use on an existing post and the stand alone version are similar.

It can also be seen that a new and improved trash receptacle to facilitate collecting and removal of trash has been provided. Not only does the trash basket prevent water which fills the basket to inhibit removal of the contents of the baskets but it also facilitates removal of all contents in the baskets.

Without further elaboration, the foregoing will so fully illustrate my invention that others may, by applying future knowledge, adopt the same for use under various conditions of service.

What is claimed as the invention is:

1. A trash receptacle to facilitate collecting and removal of trash, said trash receptacle comprising a pair of baskets and a supporting member for said baskets, said baskets being connected to said supporting member by a rotatable mounting means which mounts said baskets on diametrically opposed sides of said supporting member, fixing means for fixing each of said baskets against rotation with respect to said supporting member, said rotatable mounting means including an axis of rotation which extends through said supporting member enabling said baskets to be rotated with respect to said supporting member when said baskets are receiving trash and enabling each of said baskets to be rotated by releasing said fixing means, said fixing means comprises a rod slidably connected to each basket, said supporting member including a pair of diametrically opposed openings in said supporting member aligned with each said slidable member rod when each said basket is in an upright position vertically disposed with respect to the axis thereof, each said rod slid in a horizontal direction to enable the rods to be slid in said openings to fix said baskets with respect to said supporting member.

2. The trash receptacle of claim 1 wherein said support member is a vertically extending post and a suitable bracket is provided for rotatably supporting said baskets on said post, said bracket being connected to said vertical post by a pair of arcuate straps which embrace said post.

3. A trash receptacle to facilitate collecting and removal of trash, said trash receptacle comprising a basket and a supporting member for said basket, said supporting member being connected to said basket by a rotatable mounting means which enables said basket to be rotated with respect to said support and means for fixing said basket with respect to said support when said basket is being used as a receptacle for receiving trash, said rotatable mounting means having an axis of rotation which extends through said supporting member, said basket being rotatable about said axis of rotation, said means for fixing comprising a rod slideably connected to said basket and an opening in said supporting member, said rod being slid in said opening to fix said basket with respect to said supporting member, said supporting member comprising a vertically extending post and a suitable bracket being provided for rotatably supporting said basket on said post, said bracket being connected to said post by a pair of straps which embrace said post.

* * * * *